US005206101A

United States Patent [19]

Schonenberg

[11] Patent Number: 5,206,101

[45] Date of Patent: Apr. 27, 1993

[54] METHOD OF AND APPARATUS FOR FORMING A MULTI-COLOR IMAGE

[75] Inventor: Jacobus H. M. Schonenberg, Velden, Netherlands

[73] Assignee: Oce-Nederland B.V., Venlo, Netherlands

[21] Appl. No.: 616,089

[22] Filed: Nov. 20, 1990

[30] Foreign Application Priority Data

Nov. 27, 1989 [NL] Netherlands ..... 8902918

[51] Int. Cl.[5] ..... G03G 13/01

[52] U.S. Cl. ..... 430/44; 430/45; 430/49; 430/54; 355/244

[58] Field of Search ..... 430/44, 45, 49, 54; 355/244

[56] References Cited

U.S. PATENT DOCUMENTS 2,986,466 5/1961 Kaprelian ..... 430/44
4,518,246 5/1985 Spitzner et al. ..... 430/44
4,578,331 3/1986 Ikeda et al. ..... 430/42

FOREIGN PATENT DOCUMENTS 074147 8/1964 United Kingdom .

OTHER PUBLICATIONS

JP-A 134485, English translation of abstract.

*Primary Examiner*—Marion E. McCamish
*Assistant Examiner*—S. Rosasco
*Attorney, Agent, or Firm*—Birch, Stewart, Kolasch & Birch

[57] ABSTRACT

A method and apparatus for forming a multi-color image in which colored toner powder is used to form color separation images in the secondary colors magenta, cyan and yellow and also in one of the primary colors red, green or blue, such that of the color separation images formed in the secondary colors, there is formed, with transparent toner powder, at least as many color separation images so that the two primary colors not formed as separate separation images, are represented therein, affording the possibility of forming multi-color images by means of combinations of transparent and non-transparent toner powders, the method being performed by combining on an intermediate support those separation images formed with toner powder not required to be transparent and then transferring them to an image receiving material and subsequently transferring in registration to the image receiving material those separation images which are required to be formed with transparent toner powder.

6 Claims, 1 Drawing Sheet

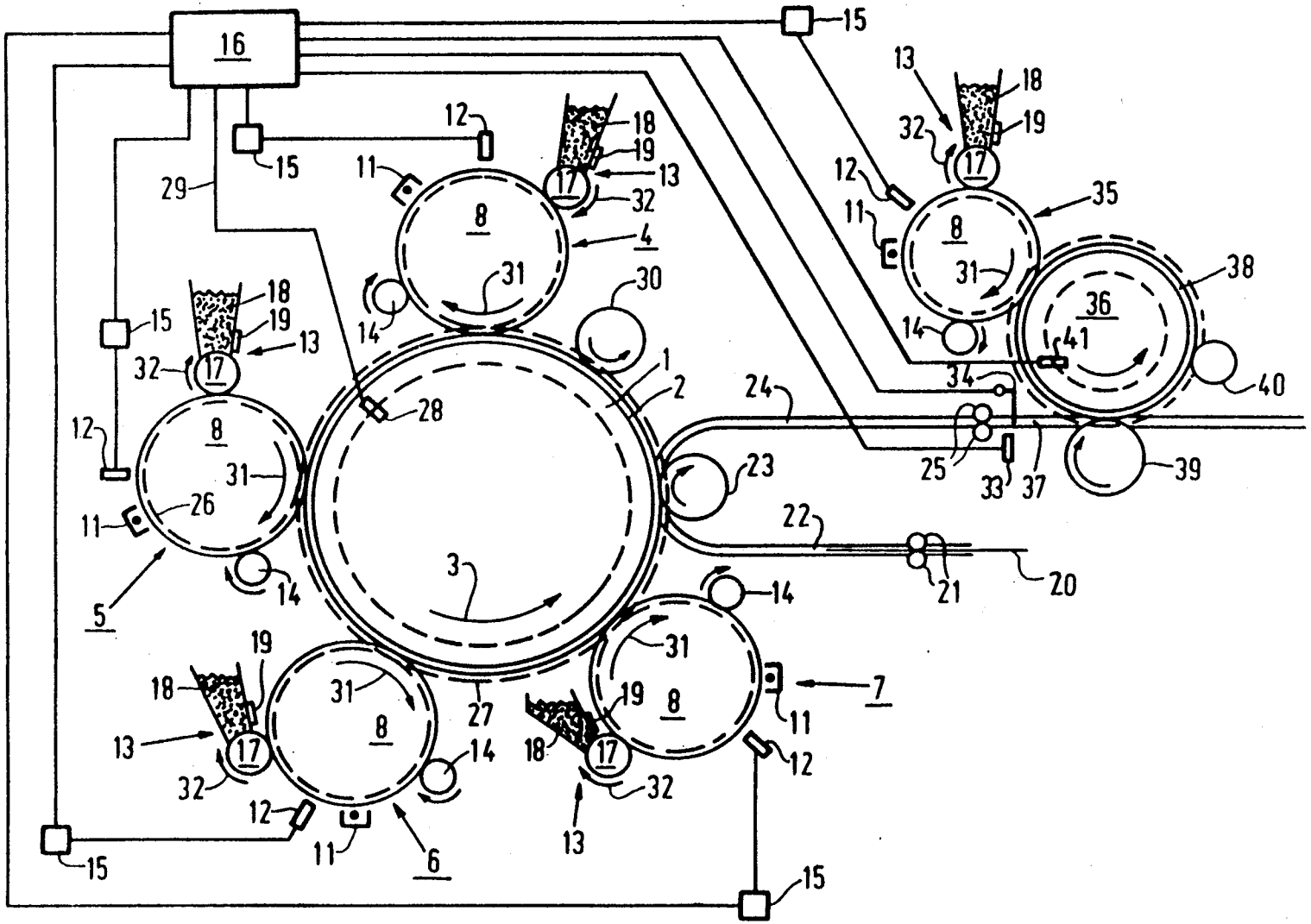

METHOD OF AND APPARATUS FOR FORMING A MULTI-COLOR IMAGE

BACKGROUND OF THE INVENTION

The invention relates to a method of forming a multi-color image and more specifically to an electro(photo)-graphic or magnetographic color imaging system in which color separation images are formed utilizing colored toner powders, in at least the secondary colors of magenta (red/blue), cyan (green/blue) and yellow (red/green) and the color separation images are combined to produce a multi-color image.

In electrostatography and electrophotography, just as in other printing techniques such as planographic and intaglio printing, multi-color images are obtained by forming color separation images by means of transparent colored material in the colors of magenta, cyan and yellow and transferring these color separation images, possibly together with a separation image in black, to an image receiving material in registration.

The separation images are formed by generating charge patterns successively in accordance with each separation image on a dielectric or photoconductive element, and developing the respective charge patterns with the associated colored transparent toner powder of magenta, cyan and yellow.

To develop the successive charge patterns, three different two-component developer powders are used, each comprising carrier particles and transparent colored toner particles in the colors of magenta, cyan and yellow, respectively. The composition of these developer powders is so selected that the toner particles are charged tribo-electrically against the carrier particles to a charge polarity which is opposite to that of the charge pattern to be developed. A method of this kind together with the apparatus for performing the method are disclosed inter alia in U.S. Pat. No. 2,986,466 and UK patent 1,074,147.

The developer powders used in this method have to satisfy a large number of requirements. For example, they must all have substantially the same development characteristic, which means that their tribo-electric behavior must be substantially the same under all conditions which may occur in the multi-color printer. The dyes in the toner powders must dissolve completely in the resin used in the toner powder, or be very finely distributed therein to produce transparent toner powder. They must also have sufficiently high stability and suitable absorption characteristics for use in multi-color reproduction. Since the various dyes often influence the tribo-electric properties of the toner powder in different ways, it is difficult to make up different toner powders for combined use in a multi-color reproduction system of the type referred to above. A frequent disadvantage in known combinations of colored transparent toner powders is accordingly that one or more mixed colors, e.g. one of the primary colors of red, green and blue, produced by subtractive mixing of the toner powders on the image receiving support, do not have the actually required color tint.

In addition to transparent colored toner powders, non-transparent colored toner powders are also known, e.g. colored magnetically attractable toner powders, as described in European patent application 075 346. These toner powders can also be used as single-component developer powders, i.e. without being mixed with carrier particles, in electro(photo)graphic printing processes and are also suitable for use in magnetographic printing processes in which latent magnetic images are developed. Multi-color printing can also be carried out in principle with non-transparent colored toner powders, but in order to achieve a complete color palette it would be necessary to use seven color separation images in red, green, blue, magenta, cyan, yellow and black, respectively. It is, however, a complex and expensive operation to construct a printer in which seven different color separation images are generated for transfer in register to an image receiving support.

BRIEF DESCRIPTION OF THE DRAWINGS

Therefore, it is an object of the present invention to provide a multi-color imaging system which will overcome the above noted disadvantages.

SUMMARY OF THE INVENTION

It is a further object of the present invention to provide a method of printing multi-color images which allows a wider choice of colored toner powders and also affords the possibility of extensive use of colored, non-transparent toner powders without it being necessary to generate seven color separation images.

The foregoing objects and others are accomplished in accordance with the present invention, generally speaking, by providing a method of forming a multi-color image of the type wherein color separation images are formed with colored toner powders and the separation images are combined to form the multi-color image. Color separation images are formed in at least the secondary colors (magenta, cyan and yellow) and one of the primary colors (red, green or blue) with colored toner particles and, of the separation images which are formed in the secondary colors, at least as many are formed with transparent toner powder such that the remaining two primary colors are represented therein.

In the method according to the present invention only one of the separation images has to be formed of a transparent colored toner powder. The other separation images can be produced with transparent or non-transparent colored toner powder, so that there is available a wider choice of options for making up a suitable color combination. Since non-transparent toner powders can also be used, the invention affords the possibility of using magnetically attractable toner powders which can be used as one-component developer powders and which can be processed in developing devices which can be of much simpler construction than the developer devices for use with two-component developer powders. Since magnetically attractable toner powders can be used, it is also possible to use magnetographic image forming methods or image forming methods as described in European patent application 0,191,521 for the image registration of at least a designated number of the separation images, so that image registration media of a much longer life than the photoconductive image registration media can be used.

Although the method according to the present invention can make extensive use of non-transparent colored toner powders, it is not necessary to form seven color separation images, but only four or five, in order to obtain a multi-color image. These color separation images consist of one primary color, red, green or blue, and the secondary colors, magenta, cyan and yellow. A separation image in black can be added as a fifth separation image.

The following table shows which of the secondary colors should be transparent when a specific primary color is used. All the other colors used, including the primary color, may be optionally transparent or opaque:

| Primary Color | Transparent Colors |
|---|---|
| Blue | yellow or magenta and cyan |
| Red | cyan or magenta and yellow |
| Green | magenta or cyan and yellow |

In forming a multi-color image containing mixed colors in the method according to the instant invention, the various color separation images are, of course, so applied to the image receiving material that the separation images required to be formed with transparent powder are finally applied over the other separation images. Preferably, the method is performed by first combining in register on the image receiving material those separation images of the primary color and of the secondary colors which are not or need not be transparent, or combining them in register on an intermediate support and then transferring them together to the image receiving material and finally applying over the combined separation images on the image receiving material that separation image (or separation images) required to be formed with the transparent toner powder.

In a preferred embodiment of the method according to the present invention, the primary color used is blue and the transparent secondary color yellow. Consequently, a register error which may occur on separate transfer of the transparent yellow separation image to the image receiving material already provided with the other separation images is less disturbing, because the sensitivity to a register error is minimum in the case of yellow.

The present invention also relates to an apparatus particularly suitable for performing the method according to the invention. Such an apparatus comprises an intermediate support for combining in register color separation images, one or more image forming stations for forming color separation images each consisting of colored toner powder on the intermediate support, a first image transfer means for transferring the color separation images to an image receiving material fed thereto, and a second image transfer means disposed in a conveyor path for the image receiving material and after the first image transfer means, the second image transfer means acting on the same side of the image receiving material as the first image transfer means for transferring to the image receiving material at least one subsequent color separation image formed by means of a transparent toner powder.

DETAILED DESCRIPTION OF THE INVENTION

The invention will now be explained in detail with reference to the following description and accompanying drawing FIG. 1 which diagrammatically illustrates the printing apparatus for performing the method according to the present invention.

The printing apparatus illustrated comprises a cylindrical intermediate support 1 which can be driven by drive means (not shown) in the direction of arrow 3. The intermediate support 1 has a metal sleeve, e.g. of aluminum, and an outer silicone rubber covering 2 thereon. The outer covering consists of a substrate of a thickness of about 2 mm formed for example from silicone rubber RTV 200/201 made by Messrs Possehl of West Germany, having coated thereon a top layer of silicone rubber approximately 200/u thick in accordance with example 8 of UK patent 1,279,687, and having a hardness of about 40'Shore A. Image forming stations 4, 5, 6 and 7 are disposed along the peripheral path of the intermediate support 1. Each of these image forming stations comprises a cylindrical image registration element 8 on which a separation image is formed. The image registration elements 8 have the same diameter and are all in pressure contact with the intermediate support 1, the force with which the image registration elements 8 are pressed against the intermediate support being at maximum 1000 N per linear meter. In this case the force is 250 N.

Each image registration element 8 consists of a cylinder having a photoconductive surface layer, with the various image forming units thereof being distributed around the periphery of the respective cylinder. These image forming units each comprise a corona device 11 for uniformly charging the photoconductive surface layer, an LED array 12 used for imagewise exposure, a magnetic brush device 13 for developing the resulting latent charge image to form a powder image, and a cleaning device 14 for removing residual toner after transfer of the separation image to the intermediate support 1.

The LED array 12, which is for example of the type described in U.S. Pat. No. 4,524,372, is connected to an electronic circuit 15 for actuating each LED in the array in accordance with an information pattern to be printed. The electronic circuit 15 of each image forming station is in turn connected to a central control unit 16 which feeds the information concerning the separation image to be printed to each electronic circuit 15 line by line.

Magnetic brush device 13 comprises a magnetic roller 17 disposed a short distance from the periphery of the image registration element 8 and consisting of a rotatable sleeve having a magnetic system stationary disposed therein.

A reservoir 18 is provided at the sleeve of each magnetic roller 17 and is filled with electrically conductive magnetically attractable toner powder. Each reservoir 18 contains a toner powder of a specific color. In the case illustrated here, the toner colors are successively blue, magenta, cyan and black, and the colored toner powders may or may not be transparent. At each reservoir 18 there is a wiper 19 which ensures that an even layer of toner powder is applied to the sleeve of the magnetic roller 17.

Also disposed along the peripheral path of the intermediate support 1 are feed means for a sheet of image receiving material 20, such means consisting of cooperating conveyor rollers 21 and a guide 22, a pressure roller 23, discharge means for the sheet of image receiving material 20 consisting of a guide 24 and conveyor rollers 25, and a cleaning device 30. Each image registration element 8 is driven by a gearwheel 26 mounted on the rotational shaft of the image registration element 8 and engaging with a gearwheel 27 secured on the drive shaft of the intermediate support 1. (In FIG. 1, the gearwheels 26 and 27 are shown as broken-line circles indicating the pitch circles of the gearwheels).

A pulse transmitter 28 is connected to the intermediate support 1 and delivers pulses in relation to the angle of rotation of the intermediate support 1. The angle of rotation between successive pulses is equivalent to a movement of the surface of the intermediate support 1 over the width of one image line. The writing of the successive image lines on the image registration elements 8 by the LED arrays 12 can thus be controlled by the control unit 16 by reference to the pulses delivered by the pulse transmitter 28, fed to the control unit 16 via the connection 29.

When the printer is in operation, the intermediate support 1, the image registration elements 8 and magnetic rollers 17 are driven in the direction indicated by arrows 3, 31 and 32. Under these conditions, the photoconductive layer of an image registration element 8, after having been given a uniform electrostatic charge by the corona device 11, is exposed imagewise by the LED array 12, whereupon the latent charge image is developed by the magnetic brush device 13 to produce a separation image of colored toner powder. By selective actuation of the LED's in the array in accordance with an image pattern, an image dot pattern of colored toner powder is formed on the image registration element 8.

The information concerning the image lines of the various separation images to be written is transmitted serially, line-by-line, by the control unit 16 to a shift register of the electronic circuits 15. On the subsequent receipt of the next pulse from the pulse transmitter 28, the information stored in the shift register of the first image forming station 4 is transferred to an output register and specific LED's are actuated via drivers in accordance with the image line to be written. The shift register is, in the meantime, filled with the information of the next image line. On receipt of the next pulse from the pulse transmitter 28, this image line is written. On receipt of a specific pulse from the pulse transmitter 28 the image forming means of the second image forming station 5 is also activated and on receipt of a number of later pulses, the image forming means of the next image forming station 6 and finally those of the image forming station 7, are activated. The number of pulses after which the image forming means of the second and subsequent image forming stations are actuated is predetermined from the distance between the image forming stations, as considered along the periphery of the intermediate support 1. The correct number of pulses is specified in a control program stored in a memory of the control unit 16.

The separation images formed on the image registration elements 8 are transferred in registration to the intermediate support 1 at the various pressure contact zones. The powder image present on the intermediate support 1 is then heated in a known manner to soften the image powder. The softened powder image is then transferred to an image receiving material (e.g. sheet of paper) in the pressure zone between the intermediate support 1 and the pressure roller 23, such material being fed at the correct time by the feed means 21,22. The printed image receiving material is discharged via the guide 24. The intermediate support 1 then continues past the cleaning device 30.

The image receiving material 20 provided with an image is conveyed on via the guide 37. As soon as the leading edge of the image receiving material is detected by detector 33, the drive for the conveyor rollers 25 is interrupted, so that the receiving material 20 is stopped with its leading edge against a retaining means 34. The receiving material is now situated in front of the entry to a subsequent image transfer zone formed by the pressure zone between an intermediate support 36 and a pressure roller 39. The intermediate support 36 is provided with a covering 38 corresponding to the covering 2 of the intermediate support 1. This intermediate support 36 can also be heated by a heating means (not shown) in order to soften a separation image disposed thereon. The transparent separation image, in this case the secondary color yellow, is transferred to the intermediate support 36 by image forming station 35, which is constructed in the same way as the above-described image forming stations 4,5,6 and 7. The reservoir 18 of this image forming station is, in this case, filled with a developer consisting of a mixture of transparent yellow toner powder and magnetically attractable carrier particles against which the toner powder is tribo-electrically charged to a polarity which is the opposite to that of the charge image formed on the photoconductive element 8. The image formation by the image forming station 35 is controlled by the control unit 16 in the same way as described above with reference to the image formation in the image forming stations 4,5,6 and 7, but now controlled by pulses of a pulse transmitter 41 which delivers pulses in relation to the angle of rotation of the intermediate support 36. The transport of the image receiving material 20 is again started at the correct time by the control unit 16, also in relation to the angle of rotation of the intermediate support 36, by withdrawing the retaining means 34 from the guide 37 and activating the drive for the conveyor rollers 25. The separation image of the transparent toner powder is transferred from the intermediate support in register, in the pressure zone between the intermediate support 36 and the pressure roller 39, to the images already present on the image receiving material 20, so that a complete multicolor image is formed. After the image transfer, the intermediate support 36 continues past a cleaning device 40 while the image receiving material 20 is discharged to a collecting tray or possibly re-introduced via the guide 22 to provide the reverse side with an image as well.

It will be apparent that when the method according to the present invention is performed with a combination of colored toner powders, such that two of the toner powders are required to be transparent, e.g. the combination of opaque blue and yellow with transparent cyan and magenta, the printing apparatus is so constructed that the separation images in blue, yellow and black are formed on the intermediate support 1 and the transparent separation images in cyan and magenta are generated on the intermediate support 36. In such a case, three image forming stations are disposed around the intermediate support 1 and two image forming stations around the intermediate support 36.

The information concerning the multi-color image to be printed is received by the control unit 16 from an external source, e.g. a scanner for scanning multi-color images. The received information can already be in a form which can be used directly by the control unit 16 to control the various image forming stations 4,5,6,7 and 35, but may alternatively be received in other forms. In the latter case, the control unit 16 is also equipped with image processing means to convert the received image information into specific separation image information for controlling the various image forming stations.

Variants are possible for the above-described embodiment for performing the method according to the instant invention. For example, the apparatus may be provided with just one intermediate support instead of two. As considered in the peripheral direction, the following are then disposed successively along the peripheral path of the single intermediate support: two, three or four image forming stations depending upon whether a toner powder combination is used which is required to contain one or two transparent powders and whether a separation image in black is added, then an image transfer station, a cleaning device, again one or two image forming stations, a transfer station, and finally again a cleaning station. The conveyor means for the image receiving material are again so constructed that the image receiving material after passing through the first image transfer station is fed to the second image transfer station where it is brought into contact with the intermediate support by that side which was also in contact with the intermediate support at the first image transfer station.

Multi-color printers known per se can also be used to perform the method according to the instant invention. For example, use can be made of an apparatus comprising a number of (four or five) successive image forming stations, in which the image receiving material passes successively through the various image forming stations, and receives one separation image in each case. It is also possible to use an apparatus which comprises one image registration element, one image forming device and a number of (four or five) developer devices and in which the various color separation images are formed in consecutive rotational cycles of the image registration element and each separation image formed is transferred separately, in registration, to the image receiving material or each separation image is first transferred in register to an intermediate support and the multi-color image is then transferred in one transfer step to the image receiving material. If the multi-color image is first formed on an intermediate support and is then transferred from there, in one step, to the image receiving material, the separation images (or separation image) to be printed with transparent toner powder should first be formed, followed by the other separation images. The purpose of this is to ensure that the transparent separation images are situated over the other separation images on the final image receiving material.

The above-illustrated embodiment of the image forming stations can also be replaced by one or more other image forming devices known from the prior art, e.g. based on a magnetographic, electrographic or electrophotographic process, in which a latent magnetic or electrostatic image dot pattern is formed on an image registration medium and the image is developed with colored toner powder, or in which colored and possibly conductive toner powder is drawn, by selective actuation of image forming electrodes, in accordance with an image dot pattern, towards a dielectric from a toner supply means which is in contact with or at a short distance from the dielectric.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A method of forming a multi-color image of the type wherein color separation images are formed with colored toner powders and the separation images are combined to form the multi-color image, comprising forming color separation images in at least the secondary colors (magenta, cyan and yellow) and one of the primary colors (red, green or blue) with colored toner powders and registering these color separation images to produce said multi-color image, wherein of the color separation images which are formed in the secondary colors, at least as many as formed with transparent toner powder such that the two remaining primary colors not represented as color separation images, are represented by said color separation images in said secondary colors formed by said transparent toner powder.

2. A method according to claim 1, wherein the separation image in the secondary color formed with transparent toner powder is complementary to the primary color used.

3. A method according to claim 1, wherein said separation image formed of the primary color is blue.

4. A method according to claim 3, wherein said separation image formed of the secondary color with transparent toner powder comprises a transparent yellow toner powder.

5. A method according to claim 3, wherein said separation image formed of the secondary color with transparent toner powder comprises two color separation images, one magenta and one cyan.

6. A method of forming a multi-color image according to claim 1, wherein said color separation image of said primary color and said color separation images of said secondary colors which need not be formed of transparent toner are combined in registration on an image receiving material and said color separation image or images required to be formed of said transparent toner powder are applied over said combined color separation images, in registration, on said image receiving material.

* * * * *